United States Patent [19]

Whang

[11] Patent Number: 4,908,182

[45] Date of Patent: Mar. 13, 1990

[54] RAPIDLY SOLIDIFIED HIGH STRENGTH, DUCTILE DISPERSION-HARDENED TUNGSTEN-RICH ALLOYS

[75] Inventor: Sung H. Whang, Huntington, N.Y.

[73] Assignee: Polytechnic University, Brooklyn, N.Y.

[21] Appl. No.: 180,080

[22] Filed: Apr. 11, 1988

[51] Int. Cl.[4] ..... C22C 27/04

[52] U.S. Cl. ..... 420/430; 148/403; 420/431; 420/432

[58] Field of Search ..... 420/430, 431, 432; 148/403

[56] References Cited

U.S. PATENT DOCUMENTS

| | | | |
|---|---|---|---|
| Re. 29,547 | 2/1978 | Severns, Jr. et al. | 148/32 |
| 1,788,243 | 1/1906 | Laise | 420/430 |
| 1,807,581 | 1/1931 | Bates | 420/430 |
| 2,180,826 | 11/1939 | Hensel et al. | 200/166 |
| 2,997,225 | 3/1961 | Wlodek | 75/176 |
| 3,150,971 | 9/1964 | Weissert et al. | 75/176 |
| 3,351,438 | 11/1967 | Millner et al. | 29/182 |
| 3,356,542 | 12/1967 | Smith | 148/32.5 |
| 3,563,873 | 2/1971 | Beyer | 204/192 |
| 3,661,536 | 5/1972 | Shimizu et al. | 29/182 |
| 3,803,238 | 9/1975 | Grinder et al. | 29/182 |
| 3,988,118 | 11/1976 | Grierson et al. | 148/32 |
| 4,062,677 | 12/1977 | Perfect | 420/430 |
| 4,212,343 | 7/1980 | Narashimhan | 164/164 |
| 4,221,257 | 9/1980 | Narashimhan | 164/87 |
| 4,743,513 | 5/1988 | Scruggs | 428/668 |

FOREIGN PATENT DOCUMENTS 160373 3/1921 United Kingdom .

OTHER PUBLICATIONS

S. H. Whang, J. Metals, 36, 34 (1984).

C. S. Chi and S. H. Whang, Mat. Res. Soc. Symp. Proc.

S. M. L. Sastry et al., *J. Metals*, 35, 21 (1983).

S. H. Whang and B. C. Gressin, *Proc. Third Conf. Rapid Solidification Processing*, R. Mehrabian, editor, NBS, 439–442.

S. H. Whang, *J. Mat. Sci.*, 21(7), 2224 (1986).

J. Hubert et al., "Manufacture of Metallic Wires and Ribbons by the Melt Spin and Melt Drag Processes", *Z. Metallk*, 64, 835 (1973).

P. Pietrokowsky, "Novel Mechanical Device for Producing Rapidly Cooled Metals and Alloys of Uniform Thickness," *Rev. Sci. Instrum.*, 34, 445–446 (1963).

R. W. Cahn, "Novel Splat Quenching Techniques and Methods for Assessing Their Performance", *Mater. Sci. Eng.*, 23, 84–86 (1976).

M. Ohring and A. Haldipur, "A Versatile Arc Melting Apparatus for Quenching Molten Metals and Ceramics", *Rev. Sci. Instrum.*, 42, 530–531 (1971).

*Primary Examiner*—Upendra Roy

*Attorney, Agent, or Firm*—Curtis, Morris & Safford

[57] ABSTRACT

Tungsten-rich alloys of formula $W_{100-P}M_XRE_YME_Z$ wherein W is tungsten, M is one or more elements selected from the group consisting of transition elements, RE is an element selected from the group consisting of rare earth and actinide elements, ME is silicon, boron, germanium or aluminum, X is 0 to 25 weight %, Y is 0 to 2 weight %, Z is 0.1 to 3 weight % and $P=X+Y+Z$ where $P \leqq 26$ weight % are disclosed. The alloys possess high strength and ductility. A method for preparing the alloys by rapid solidification processing is also disclosed.

8 Claims, 15 Drawing Sheets

200,000 X 100,000 X 30,000 X 120,000 X

RAPIDLY SOLIDIFIED HIGH STRENGTH, DUCTILE DISPERSION-HARDENED TUNGSTEN-RICH ALLOYS

FIELD OF THE INVENTION

The present invention relates to the field of tungsten alloys and, more particularly, to novel dispersion-hardened tungsten-rich alloys containing silicon, boron, germanium or aluminum and to a method for preparing such alloys via rapid solidification processing.

Several publications are referenced in this application by Arabic numerals within parentheses. Full citation for these references is found at the end of the specification immediately preceding the claims. These references describe the state-of-the-art to which this invention pertains.

BACKGROUND OF THE INVENTION

Tungsten-rich alloys are characterized by high melting points and high strength and because of these properties, they cannot be readily replaced by other alloys. Despite the importance of these properties, research on the synthesis of tungsten alloys has lagged behind other alloy systems because the very high melting temperatures of these alloys do not permit the use of many common processing techniques. For example, alloy processing for tungsten has been for the most part limited to conventional powder metallurgy or arc casting techniques. Conventional mixing of elemental powders followed by sintering affords large particles and does not afford a fine particle dispersion.

In recent years, rapid solidification processing (RSP) has become one of the most important and significant methods for enhancing the properties of materials. A number of benefits have been demonstrated by the synthesis of many other alloy systems by RSP. For example, entirely new alloys can be made utilizing a flexible selection of alloy compositions and rapid solidification conditions. In addition, highly refined and homogeneous microstructures can be produced through rapid solidification. Further, very stable dispersoids can be created in the matrix through the utilization of novel additives and aging treatments. Previous studies on RSP alloys have been documented (1, 2). Among the results, specific examples that have shown enhanced characteristics resulting from RSP are found in dispersion strengthened aluminum and titanium alloys containing rare earth metals (3, 4, 5, 6, 7).

Tungsten alloys can be strengthened by alloying, plastic deformation and dispersion mechanisms (8, 9). The alloying and plastic deformation mechanisms become less effective at high temperatures. At such high temperatures, dispersion is the only effective strengthening mechanism because the dispersoid becomes the most important dislocation barrier and stabilizes subgrain boundaries and dislocation substructure through the impediment of dislocation movement.

Conventional dispersion-hardened alloys rely predominantly on carbide, nitride and oxide-based particles. The most widely used are titanium carbide, zirconium carbide and hafnium carbide. For example, carbide dispersion is widely used for strengthening molybdenum alloys. It was found that carbide dispersions not only increase the strength of the alloy but also raise the temperature for recovery and recrystallization. However, the high solubility of transition metals such as titanium, zirconium and hafnium in tungsten and the diffusivity of carbon in tungsten are not ideal conditions for the coarsening resistance of the carbides of these rare earth elements. While dispersion hardened tungsten alloys containing thorium have been developed, a fine and uniform dispersion hardened tungsten alloy matrix had not been possible through conventional processing methods. In addition, because of the high melting temperatures of refractory alloys, routine rapid solidification techniques cannot be readily applied.

However, rapid solidification of refractory alloys has been recently demonstrated using an arc melt spinning technique (10). For example, niobium-silicon, molybdenum-tungsten-titanium-carbon and molybdenum-tungsten-thorium-boron alloy systems have been spun into ribbons by the arc plasma spinning technique. The advantage in this method lies in the fact that extremely refined microstructures of good uniformity can be attained through high cooling rates ranging from $10^6$ to $10^7$° K./sec.

It has been now discovered that silicon, boron, germanium or aluminum may be used as disperiods in tungsten rich alloys. Further, tungsten rich mixtures containing these dispersoids may be continuously cast by arc melt spinning to afford alloys having homogeneous, finer dispersions in the matrix and possessing high strength and good ductility.

Therefore, it is a general object of the invention to provide high strength, ductile tungsten alloys by incorporating rapid solidification processing and a versatile combination of alloying elements and additive elements. It is another object of the present invention to provide novel dispersion hardened tungsten rich alloys containing silicon, boron, germanium or aluminum as the dispersoid and having high strength and ductility. It is another object of the present invention to provide a process for preparing tungsten rich alloys containing silicon, boron, germanium or aluminum via rapid solidification processing.

These and other objects, advantages and features of the present invention will become more readily apparent after consideration of the following.

SUMMARY OF THE INVENTION

The invention is broadly directed to tungsten-rich, dispersion-hardened alloys having the general formula $$W_{100-P}M_XRE_YME_Z$$

wherein W is tungsten, M is one or more elements selected from the group consisting of transition elements, RE is an element selected from the group consisting of rare earth and actinide elements, ME is silicon, boron, germanium or aluminum, X is from 0 to 25 weight percent, Y is from 0 to 2 weight percent, Z is from 0.1 to 3 weight percent and P equals X+Y+Z and $P \leqq 26$ weight percent. The skilled artisan will readily appreciate that the alloys according to the invention may be binary, ternary or quaternary.

The invention is also directed to a process for preparing the tungsten-rich alloys of the invention. The process comprises the steps of blending a mixture of the powered, elemental components of the alloy, compacting the blended mixture into a solid mass, hot-consolidating the compacted solid mass, melting the hot-consolidated mass and rapidly solidifying the molten mass at a cooling rate of at least 1,000° C./sec.

In still another aspect, the invention is directed to tungsten-rich, dispersion hardened alloys as described above which are prepared by blending a mixture of the powdered, elemental components of the alloy, compacting the blended mixture into a solid mass, hot-consolidating the compacted solid mass, melting the hot-consolidated mass and rapidly solidifying the molten mass at a cooling rate of at least 1000° C.

BRIEF DESCRIPTION OF THE DRAWINGS

The invention, as well as other objects, features and advantages thereof, will be understood more clearly and fully from the following detailed description, when read with reference to the accompanying drawings, in which.

DETAILED DESCRIPTION OF THE INVENTION

Figure 1:
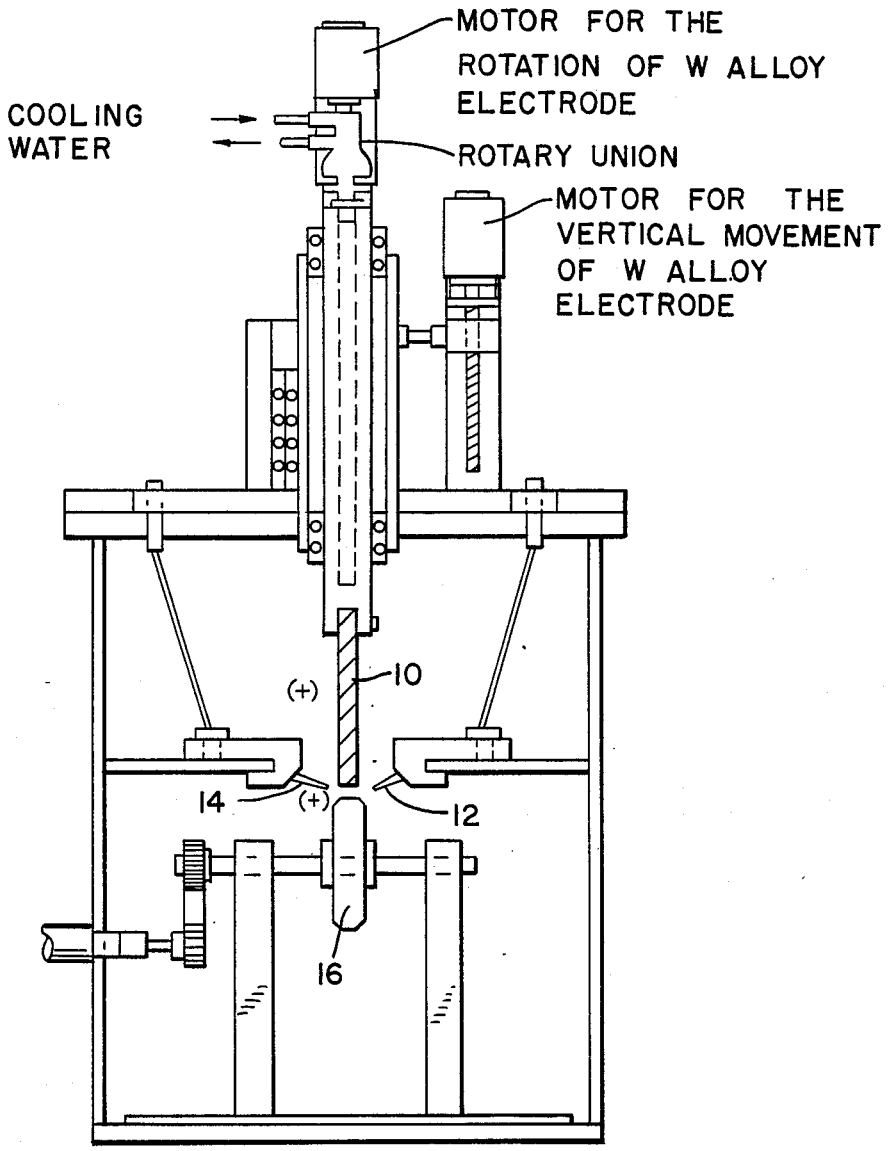
FIG. 1 shows a modified melt spinner for tungsten alloys based on a consumable electrode confined with a melt-drag mode.

The invention is directed to novel, tungsten-rich alloys which possess improved hardness and ductility as compared to pure tungsten. These novel alloys are made possible using a versatile combination of alloying elements and additive elements and incorporating rapid solidification processing. As used herein, the term "additive element" refers to dispersoids, namely silicon, boron, germanium and aluminum. The other components of the alloys of the invention other than tungsten and the dispersoids are referred to as "alloying elements".

The development of these novel tungsten alloys is based on solid solution strengthening and precipitate hardening aimed at adequate ductility with a significant strength increase from room temperature to intermediate temperatures. This development paralleled that of rapidly solidified titanium alloys and aluminum alloys (11). Therefore, the tungsten alloys of the invention are characterized by stable, coarsening resistant particles free from detrimental segregation of additive elements and by a minimum requirement of ductility and fracture toughness.

Accordingly, the invention is directed to tungsten-rich alloys having the general formula $$W_{100-P}M_XRE_YME_Z$$

as hereinbefore described. The alloys may be binary (X and Y are 0), tertiary (X or Y is 0) or quartenary (neither X nor Y is 0).

Preferred binary alloys include W-0.3Si, W-0.5Si, W-1.0Si, W-0.1B, W-0.2B, W-0.1Ge and W-0.4Al. Preferred ternary alloys include W-(2-10)Re-0.3Si and W-10Re-0.3Ge.

In another aspect, the invention is directed to a method for preparing tungsten-rich alloys. The process comprises the steps of blending a mixture of the powdered, elemental components or one alloy, compacting the blended mixture into a solid mass, hot-consolidating the compacted solid mass, melting the hot-consolidated mass and rapidly solidifying the molten mass at a cooling rate of at least 1000° C./sec.

In the first step, a mixture of high purity elemental powders, corresponding to the components of a desired alloy, are blended using typical powder blenders well known in the art. Preferably, very fine powders on the order of 300 mesh or finer are used.

The thoroughly blended powder mixture is then compacted at room temperature into a solid mass such as, for example, pellets. The compaction is carried out at pressures of about 5,000 to 20,000 psi. Compaction increases the density of the material by about 60 to 70% of the ultimate, defect-free homogenous alloy. Any of a number of means well known in the art for compacting may be used. For example, a die and press assembly may be used and the resulting size and shape of the compacted solid mass will depend on the size and shape of the die used.

The compacted solid mass is then treated with a hot-consolidating technique. Hot consolidating techniques are well known in the art and include, for example, hot isostatic pressing (HIPing), sintering, high temperature extrusion and vacuum hot pressing (12). A preferred technique is sintering whereby the compacted solid mass is heated in an oven at a temperature of about 1,400° to 2,000° C. for a period of about 2 to 10 hours. Sintering is carried out under an inert gas, preferably hydrogen. However, in the case of alloys which react with hydrogen to form hydrides, argon is preferably used. The hot-consolidated mass is then heated to its molten state and is rapidly solidified. The term "rapidly solidified" as used herein means solidification by any technique capable of achieving a cooling rate of at least 1,000° C./sec. Two such techniques well known in the art are splat-quenching and arc-melt spinning. The terms "rapidly solidified", "rapid solidification", "rapidly quenched" and "rapid quenching" are used interchangeably.

Preparation of large quantities of the tungsten-rich alloys according to the invention is preferably carried out using an arc-melt spinning technique. As noted earlier, arc-melt spinning of molybdenum and tungsten alloys with melting points up to 3,000° C. has been demonstrated.

Typically, in arc melt spinning, a premelted alloy button or ingot is placed at the bottom of a copper crucible under an inert gas atmosphere, such as argon. The crucible has an orifice which is centered at the bottom of the crucible. The button or ingot is then melted by arc plasma using a non-consumable tungsten electrode. When the melt is adequately superheated, inert gas is introduced into the crucible so as to create a pressure differential between the interior of the crucible and the exterior. As a result of this differential, the molten alloy forms a jet through the orifice centered at the bottom of the crucible. The jet subsequently impinges onto a highly conductive spinning disk underneath the crucible and is rapidly solidified into ribbons or flakes, depending on the disk employed. The flakes or ribbons are brittle enough to be pulverized by mechanical means. The powder so produced can be consolidated by hot isostatic pressing (HIPing) or extrusion.

However, tungsten alloys having melting points greater than 3,000° C., such as the alloys of the present invention, make utilization of existing arc-melt spinning techniques difficult since the temperature gradient in such alloys exceeds 3,000° C./cm. Consequently, the continuous casting of tungsten alloys by arc-melt spinning has not been previously developed.

However, it has been discovered that tungsten alloys with melting points greater than 3000° C., such as those of the present invention, may be rapidly solidified by use of a modified arc-melt spinner.

FIG. 1 is a schematic representation of such a modified spinner. The spinner does not include a crucible. In accordance with the invention, during the compaction step, the desired alloy is formed into the shape of a consumable electrode 10 which is fitted into the spinner as shown in FIG. 1. Consumable electrode 10 is melted by two negative, non-consumable electrodes 12 and 14 and the resulting molten droplets are spun into flakes by a rotating molybdenum disc 16. This process, employing a non-crucible spinner, is very similar to that of the "melt-drag" process (13, 14, 15). The non-crucible spinner shown in FIG. 1 also may be used for the continuous casting of the alloys according to the invention.

In another embodiment of the process for preparing the alloys according to the invention, the blended mixture of powdered, elemental components may be mechanically alloyed before compacting. Any number of well known techniques for mechanical alloying may be used including, but not limited to, attrition milling, tumbler ball mills, vibratory ball mills and hammer and rod mills (16). Mechanical alloying, which provides particle sizes of up to 100 angstroms, is carried out for a period of about 4 to 20 hours, preferably 10 to 20 hours.

The resulting rapidly quenched homogeneous alloys may then be pulverized and consolidated into desired shapes and sizes by HIPing, hot-extrusion, vacuum-hot-pressing or any other well-known hot consolidation techniques. The alloys according to the invention may be used in the manufacture of military tank projectiles or for any other product requiring an alloy with good hardness and ductility.

The following examples are set forth to illustrate more fully the invention.

Methods And Materials

Small tungsten alloy buttons were prepared in accordance with the invention. High purity powders of the component elements were blended as described above. Powders of tungsten, boron, silicon and germanium were obtained from Atlantic Equipment Engineers, a division of Micron Metals, Inc., Bergenfield, N.J. Rare earth (Y,Lu) and actinide (Th) metal powders were obtained from Leico Industries, Inc. of New York, N.Y. Rhenium, ruthenium and the rest of the metals were obtained from Morton Thiokol, Inc., Alfa Products, Danvers, Ma. According to one embodiment of the invention, some of these powders were compacted into pellets at a pressure of 10,000 Lb f and then the pellets were annealed at 1,500° C. for two hours under hydrogen atmosphere.

In accordance with another embodiment of the invention, some of the blended powders were charged into a small, high energy ball mill (Model: Spex 8,000) and milled for 14 hours under argon atmosphere. The milled powders again were compacted and annealed in the same manner as described above.

Figure 2:
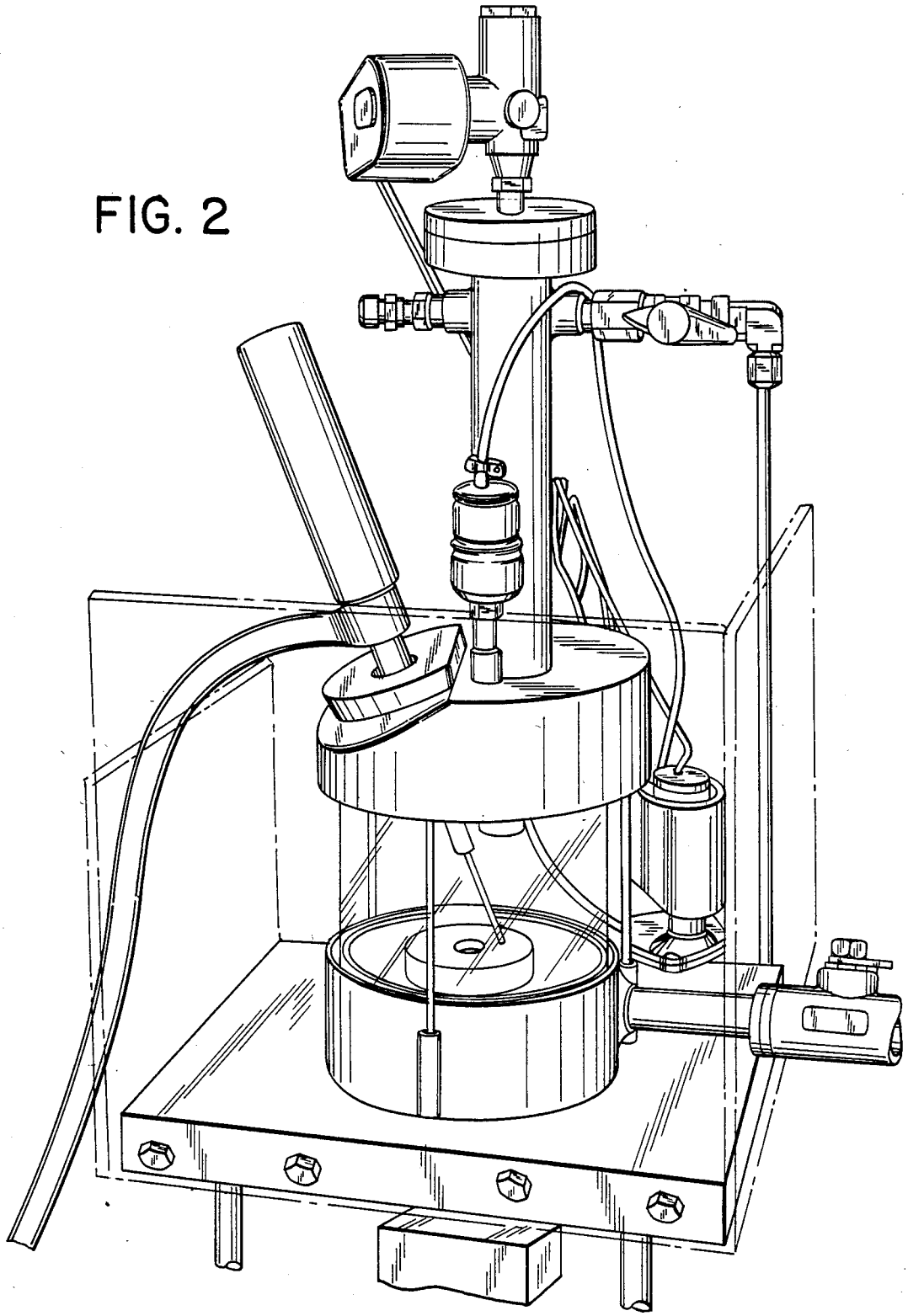
FIG. 2 shows a commercially available hammer and anvil quench unit.

The alloy buttons prepared according to either embodiment were broken up into small pieces which were then splat-quenched into thin foils (150–300μm thick) by the hammer and anvil technique (17, 18, 19) under argon atmosphere. A typical hammer and anvil apparatus is shown in FIG. 2. Characterization of the as-splat foils and the heat-treated foils was performed with respect to microstructure, ductility and hardness.

Thin films for TEM and STEM from the as-quenched foils were prepared using a solution of 85% methanol, 8% sulphuric acid, 5% lactic acid and 2% hydrofluoric acid under the conditions: 55V, 95mA, and −30° C. for 3 mm diameter foil. For the heat treated alloys, a solution of 2% NaOH and 98% methanol was employed under 13V at room temperature.

The compositional profile and particle analysis were carried out by EDX-STEM.

Figure 3A:
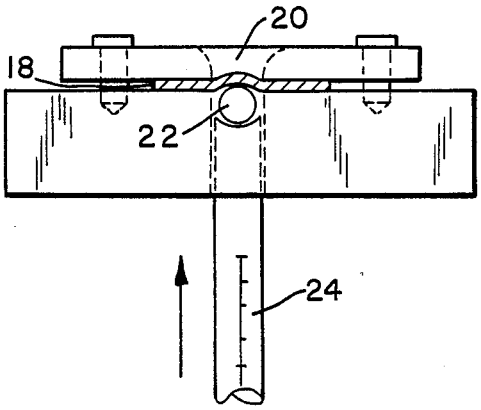
FIG. 3(*a*) shows a "bulge tester" apparatus and FIG. 3(*b*) shows the geometry of a bulged specimen.

Microhardness measurements were performed using a Leitz Hardness Tester with a 100 g load. Because of the shape of the samples, ductility was measured using a bulge test. The bulge test was performed using a small custom made tester as shown in FIG. 3*a*. The specimen 18 is held tightly on circular opening 20 and then is pressed to bulge upward by ball 22 which is pushed upwardly by pressing rod 24 from beneath, as shown in FIG. 3*a*.

Figure 3B:
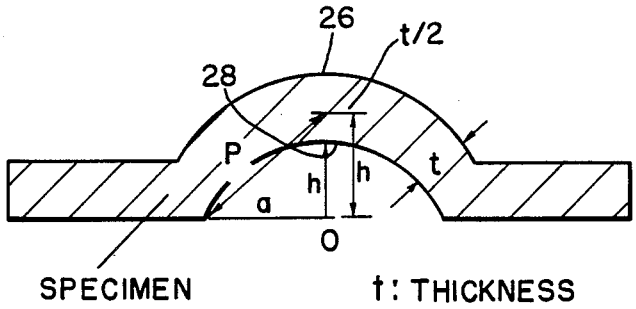

Referring now to FIG. 3*b* wherein t is the thickness of the specimen, $t/2$ is the midpoint of the thickness of the specimen at the highest point of spherical cap 26, p is the distance between $t/2$ and the boundary of spherical cap 26 of bulged bottom surface 28, O, the origin, is the center point of the projected area of the bulged surface area, a is the distance between the origin O and the boundary of spherical cap 26 of bulged bottom surface 28, h is the distance between the origin and the highest point of the bulged bottom surface 28 of the specimen, h' is the distance between the origin and $t/2$, the thickness change $\Delta t = t_l - t_o$ and thickness reduction $\Delta t/t_o(\epsilon)$ may be calculated from the following relation:

if $p^2=a^2+(h')^2$ where $h'=h+t'/2$ and $t'\simeq t$ for small strain, then the surface area of the bulged cap, S is given by the equation $$S = p^2 = \pi(a^2 + (h')^2)$$
$$= \pi(a^2 + h^2 + ht + t^2/4);$$

removing the pure thickness effect, $t^2/4$ is subtracted so that $$S=\pi(a^2+h^2+ht);$$

if the original surface area, $S_o$, is $a^2$ then, the thickness reduction, $\epsilon$, is given by the equation $$\epsilon=(t_{1l}-t_0)/t_o-t_l/t_0-1$$

where $t_1/t_0=S_0/S_l$, assuming a uniform reduction; therefore, $$\% \ \epsilon=[-(h^2+ht)/(a^2+h^2+ht)]x100$$

EXAMPLE

Preparation of W-0.5Si and W-10Re-0.3Si Alloys

Elemental W powder (99.9% purity; 1–5 μm diameter), Si powder (99.9% purity; 100 mesh) and Re powder (99.9% purity; 325 mesh) were purchased (see my letter) and weighed by an accurate analytical balance. For the W-0.5Si (wt. %) alloy, 3.287 g of W powder and 0.0165 g of Si powder were weighed. For the W-10Re-0.3Si alloy, 1.12125 g of W powder, 0.125 g of Re powder and 0.00375 g were weighed.

These powders were mixed well in a porcelain mortar. The mixed powders were then poured into a steel die and compressed into a pellet of 1 cm diameter under 10,000 Lb f. The pellets were arc heated for 2–5 minutes in an arc furnace under argon atmosphere so that the surfaces of the pellets melted to form solid masses, but without complete melting of the pellets. The solid pellets so formed were broken into pieces each weighing about 0.3–0.7 g. Each piece was completely melted by an arc electrode and then splat-quenched into foil from the molten state by the hammer and anvil quench technique. The splat-quenched foils were approximately 5 mm in diameter and 150–300 μum thick. The quenched foils were subjected to microhardness and ductility tests as described above.

The quenched foils were then wrapped with Ta foil and annealed by insertion into a tube furnace under hydrogen atmosphere. The furnace temperature was raised to 1500° C., held at 1500° C. for three hours and then slowly cooled down to room temperature. The annealed alloy foils were subjected to microhardness and ductility tests.

Microstructures

Figure 4A:
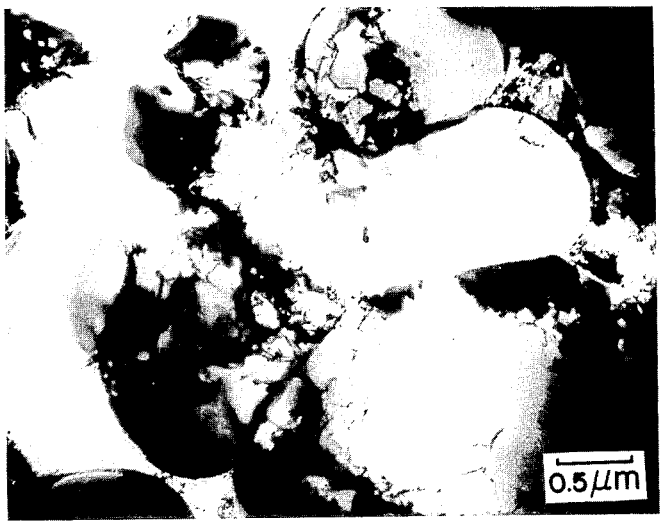
FIG. 4 shows a rapidly quenched $W_{80}Ni_{20}$(at %) foil alloy after sintering at 1500° C. for 3 hrs. in an hydrogen atmosphere, (a) and (b) showing grains in different regions of the alloy.
Figure 4B:
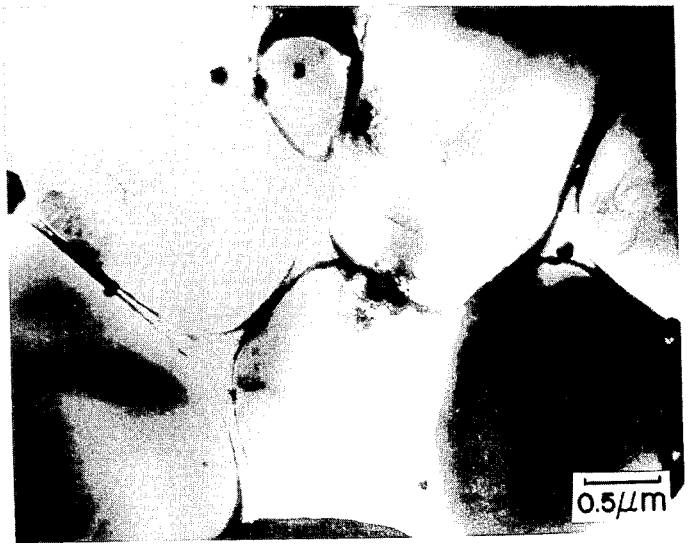

Microstructures of rapidly quenched W alloys exhibit characteristic features commonly observable in rapidly solidified alloys. These include fine grain, fine precipitates and extended solid solution of W. For example, a rapidly solidified $W_{80}Ni_{20}$ (at %) alloy comprises tungsten grains of 1–4 μm diameter (FIGS. 4*a* and *b*) as compared to 10–100 μm diameter in traditional sintered W alloys.

Figure 5A:
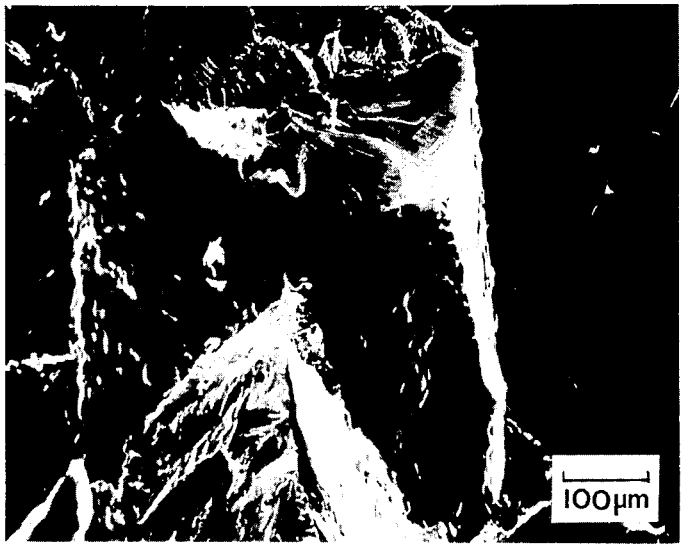
FIG. 5 is a SEM micrograph showing the fracture surface of an as-quenched and annealed pure tungsten foil (a) at low magnification (x125) and (b) at high magnification (x714)
Figure 5B:
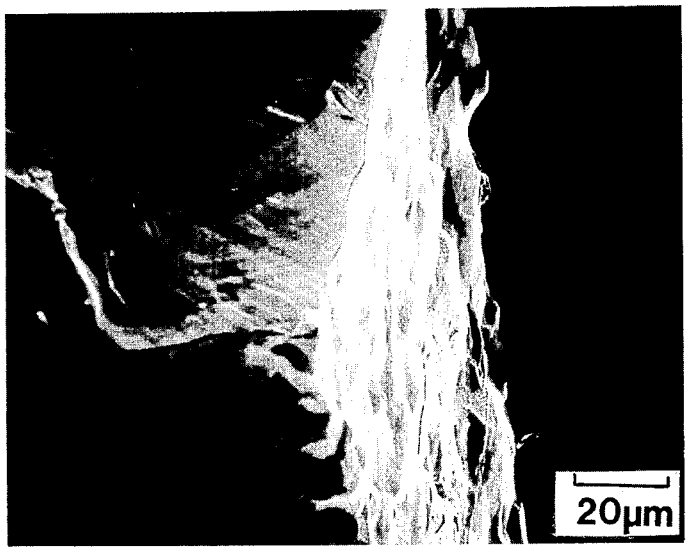
Figure 6A:
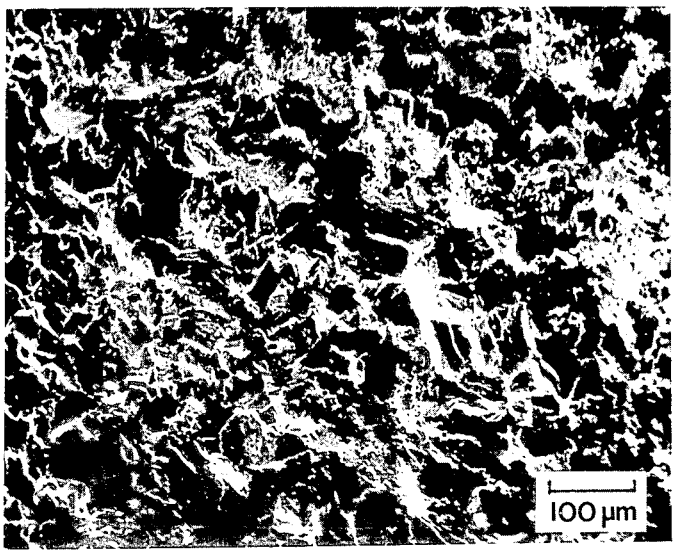
FIG. 6 is a SEM micrograph showing the fracture surface of an as-quenched and annealed W-0.5Si (wt %) alloy (a) at low magnification (x165) and (b) at high magnification (x1520)
Figure 6B:
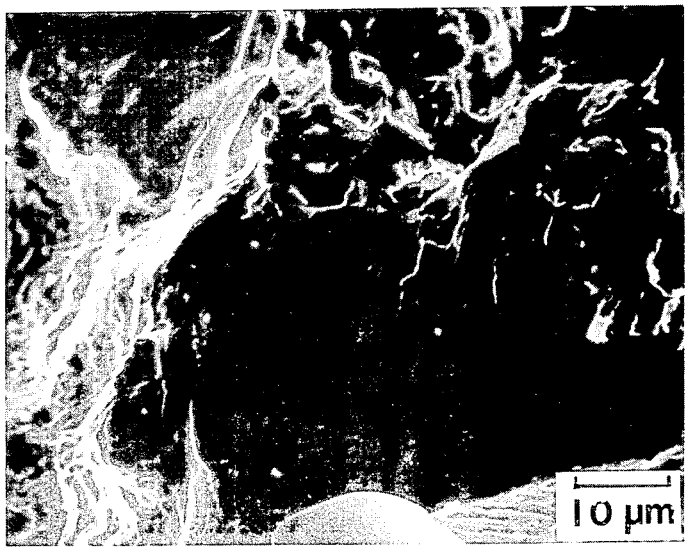
Figure 7A:
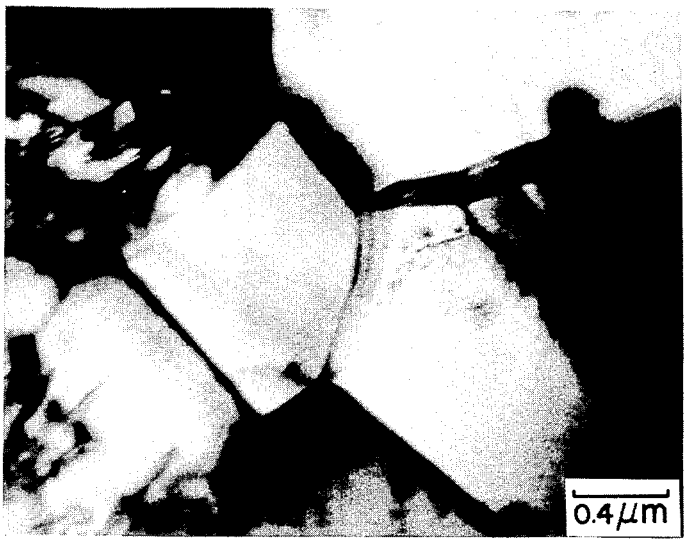
FIG. 7 is a TEM micrograph of an as-quenched and annealed W-0.5Si (wt %) alloy (a) at low magnification (x40,000) and (b) at high magnification (x60,000)
Figure 7B:
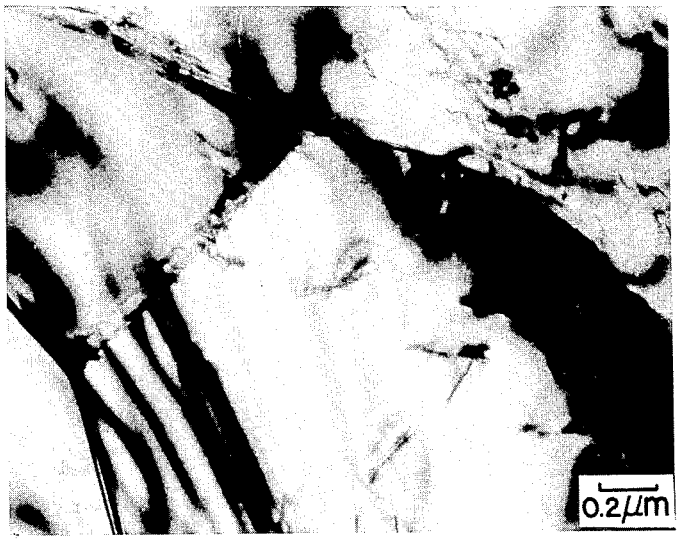

As-quenched foil of pure tungsten shows a typical intergranular fracture (FIGS. 5*a* and *b*) well known in this material. This alloy was compared to that of the W-0.5Si alloy shown in FIGS. 6*a* and *b*. FIGS. 6*a* and *b* show a transgranular fracture in contrast to the intergranular fracture shown in FIGS. 5*a* and *b* for the pure tungsten alloy. Also, it should be noted that the grain size of the W-0.5Si alloy is 1–2 μm as compared to 50–100 μm for the pure tungsten alloy. Both alloys were processed in the same manner. Hence, the nucleation mode in W-0.5Si is apparently different from the other TEM micrographs of W-0.5Si revealing 5–6 facet grains in which some dislocations were embedded (FIGS. 7*a* and *b*).

Figure 8A:
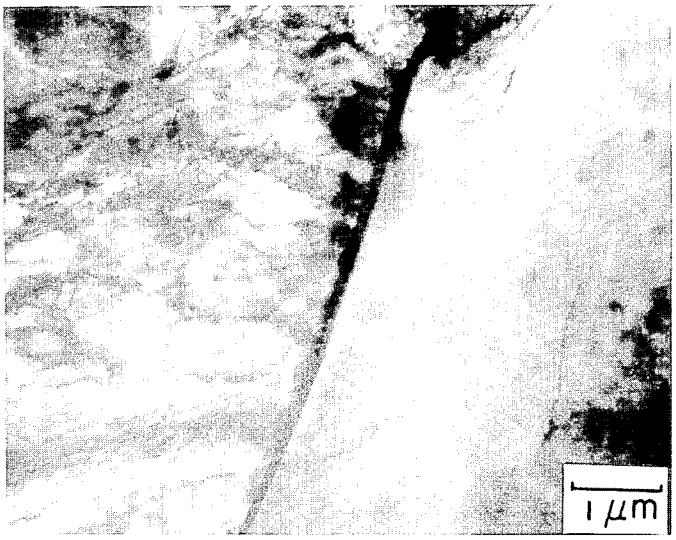
FIG. 8 is a TEM micrograph of an as-quenched W-10Re-0.3Si (wt %) alloy (a) at low magnification (x20,000) and (b) at high magnification (x40,000)
Figure 8B:
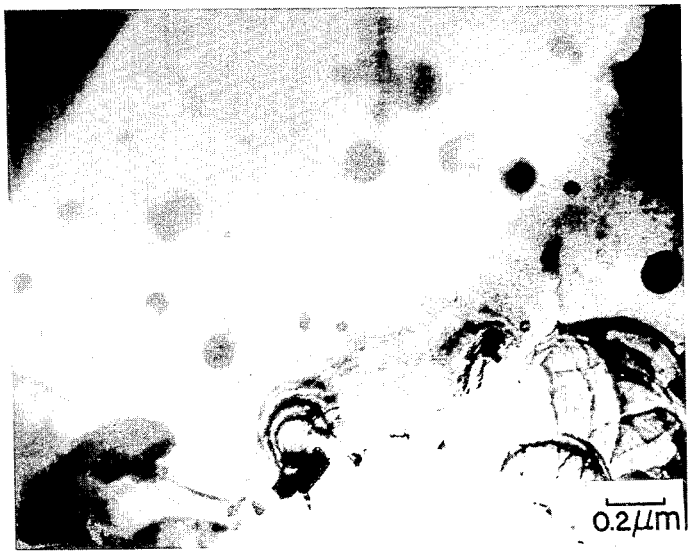
Figure 9:
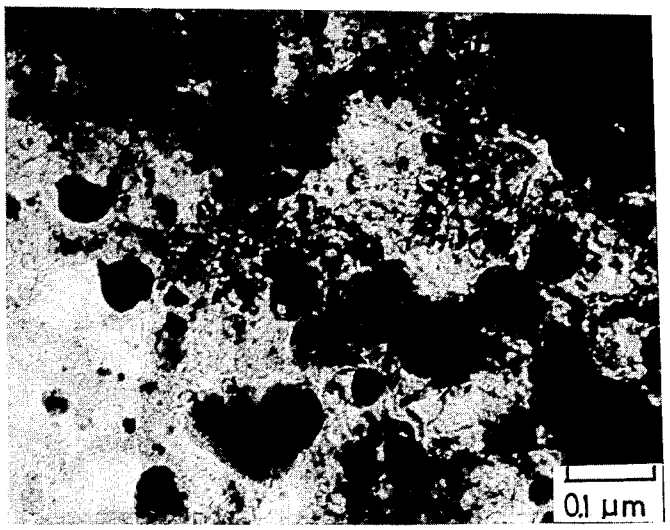
FIG. 9 is a TEM mcrograph of a rapidly quenched W-10Re-0.3Si (wt %) alloy after sintering at 1500° C. for 3 hrs. in a hydrogen atmosphere.
Figure 10A:
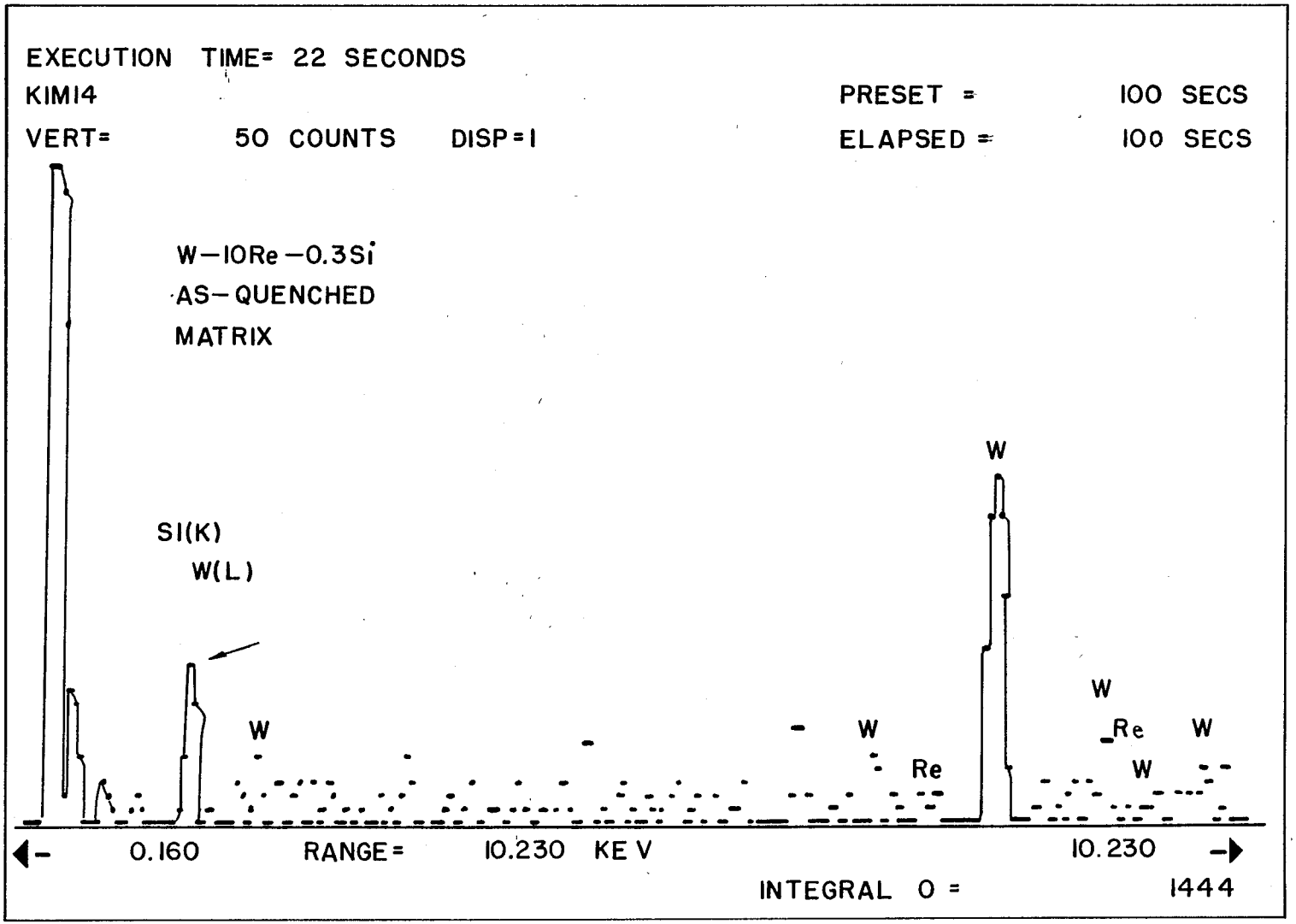
FIG. 10 shows the EDX spectra of (a) the matrix and (b) the precipitates of an as-quenched W-10Re-0.3Si (wt %) alloy.
Figure 10B:
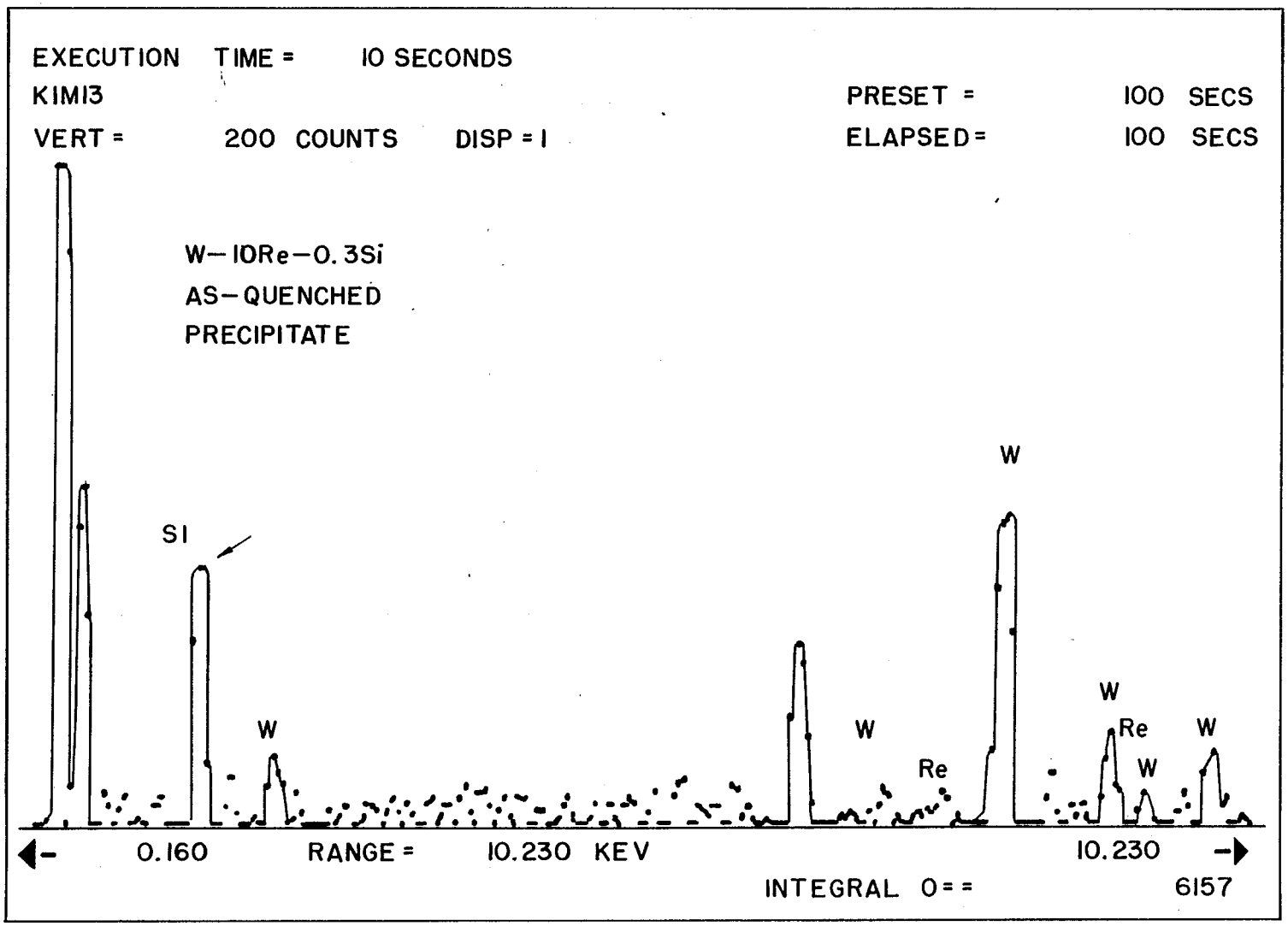

The ternary alloy W-10Re-0.3Si is essentially a solid solution in the as-quenched state (FIG. 8*a*), but in some cases contains precipitates (FIG. 8*b*). When the alloy is annealed at 1500° C., precipitation reaction is further promoted as shown in FIG. 9*b*. The matrix and the precipitates of the as-quenched W-10Re-0.3Si alloy were studied by EDX spectroscopy and the spectra are shown in FIG. 10*a* and FIG. 10*b*, respectively. The spectra show that the pure tungsten peak of the precipitates is weaker than that of the matrix whereas the composite peak of tungsten and silicon for the precipitates (arrow mark) is stronger than that of the matrix. This indicates that the precipitate contains more silicon than the matrix. The crystal structure of the precipitates can be identified from the spot diffraction patterns or conversion beam diffraction patterns by a high voltage TEM.

Figure 11A:
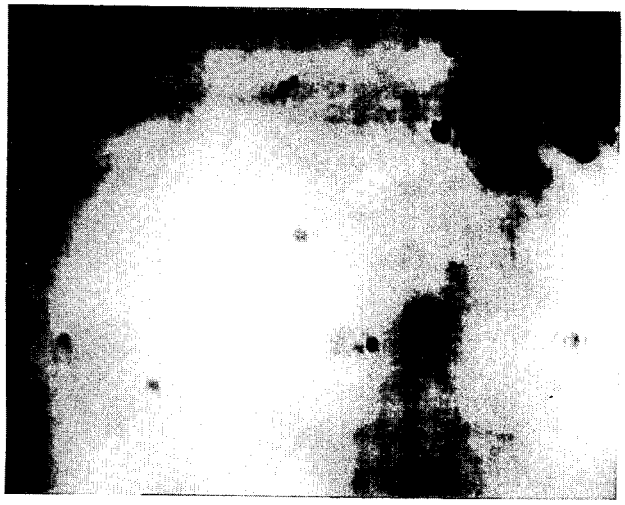
FIG. 11 is a micrograph of an as-quenched W-10Ru-0.36Ge (wt %) alloy showing (a) the general microstructure and (b) some dislocation arrays.
Figure 11B:
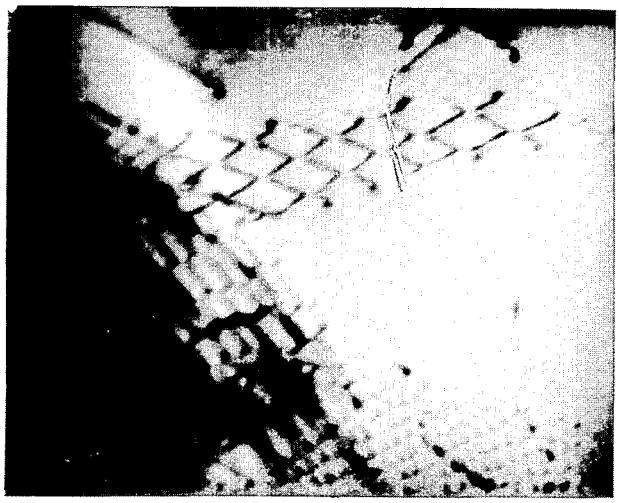
Figure 12A:
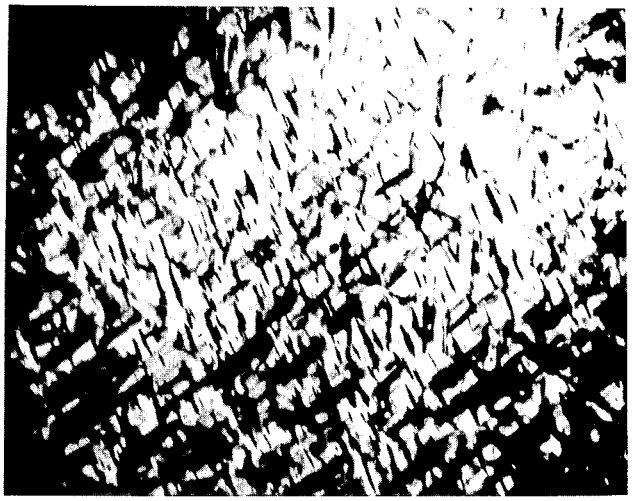
FIG. 12 shows micrographs of a rapidly quenched W-10Ru-0.3Ge (wt %) foil alloy after sintering at 1500° C. for 3 hrs. in a hydrogen atmosphere, (a) and (b) exhibiting rod-shape precipitates.
Figure 12B:
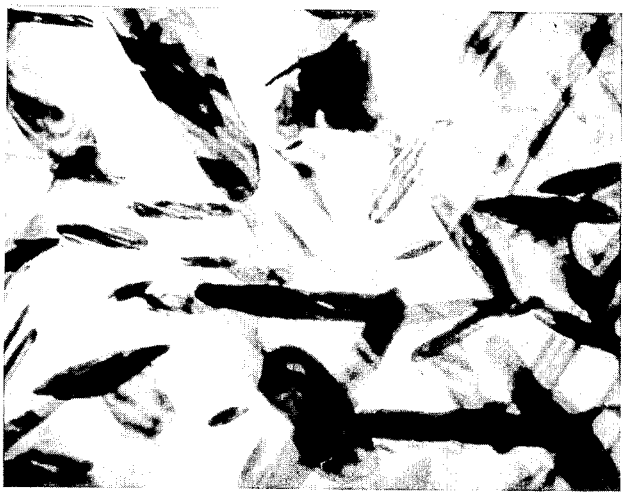
Figure 13A:
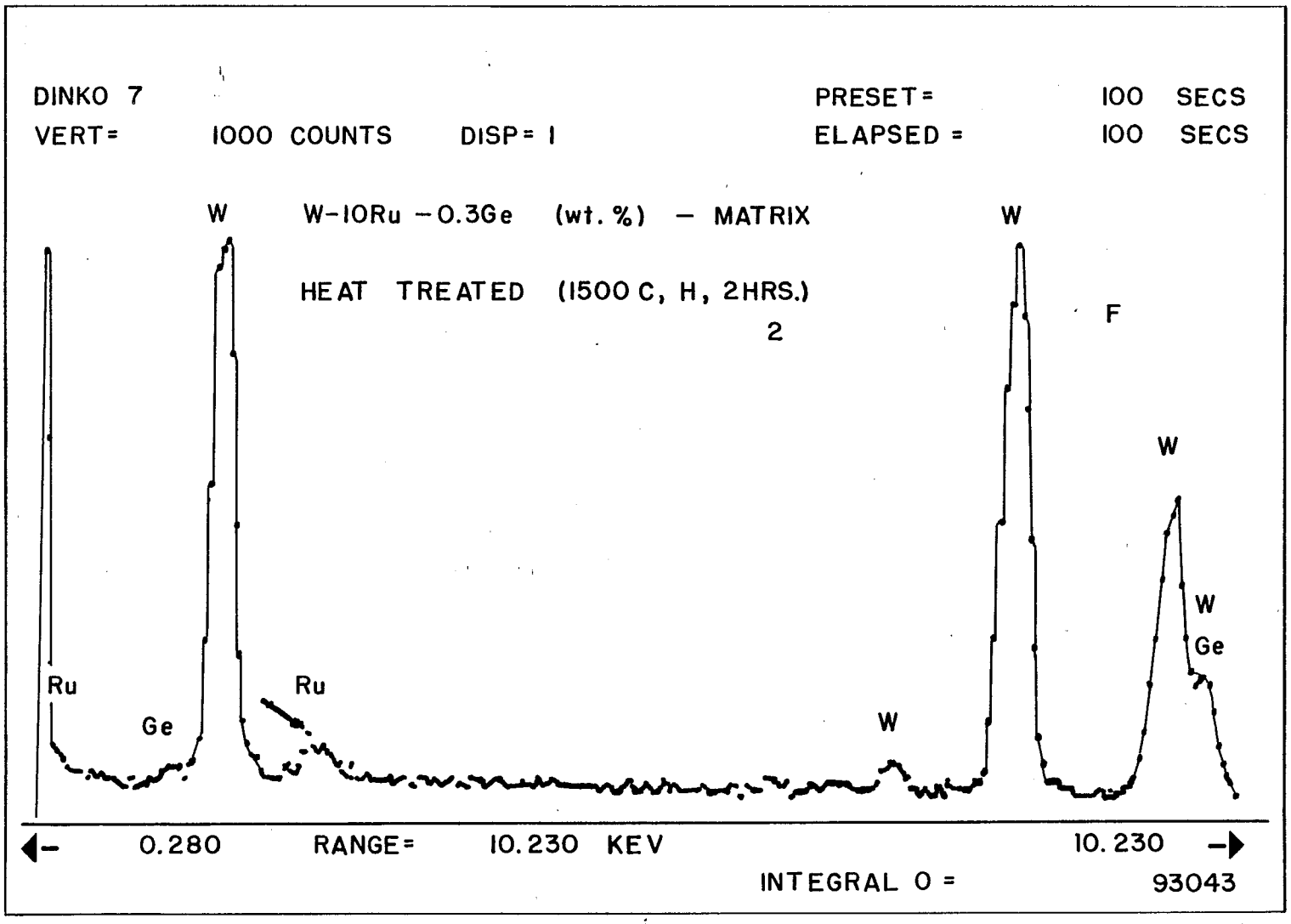
FIG. 13 shows the EDX spectra of (a) the matrix and (b) the precipitates of an as-quenched W-10Ru-0.36Ge (wt alloy.
Figure 13B:
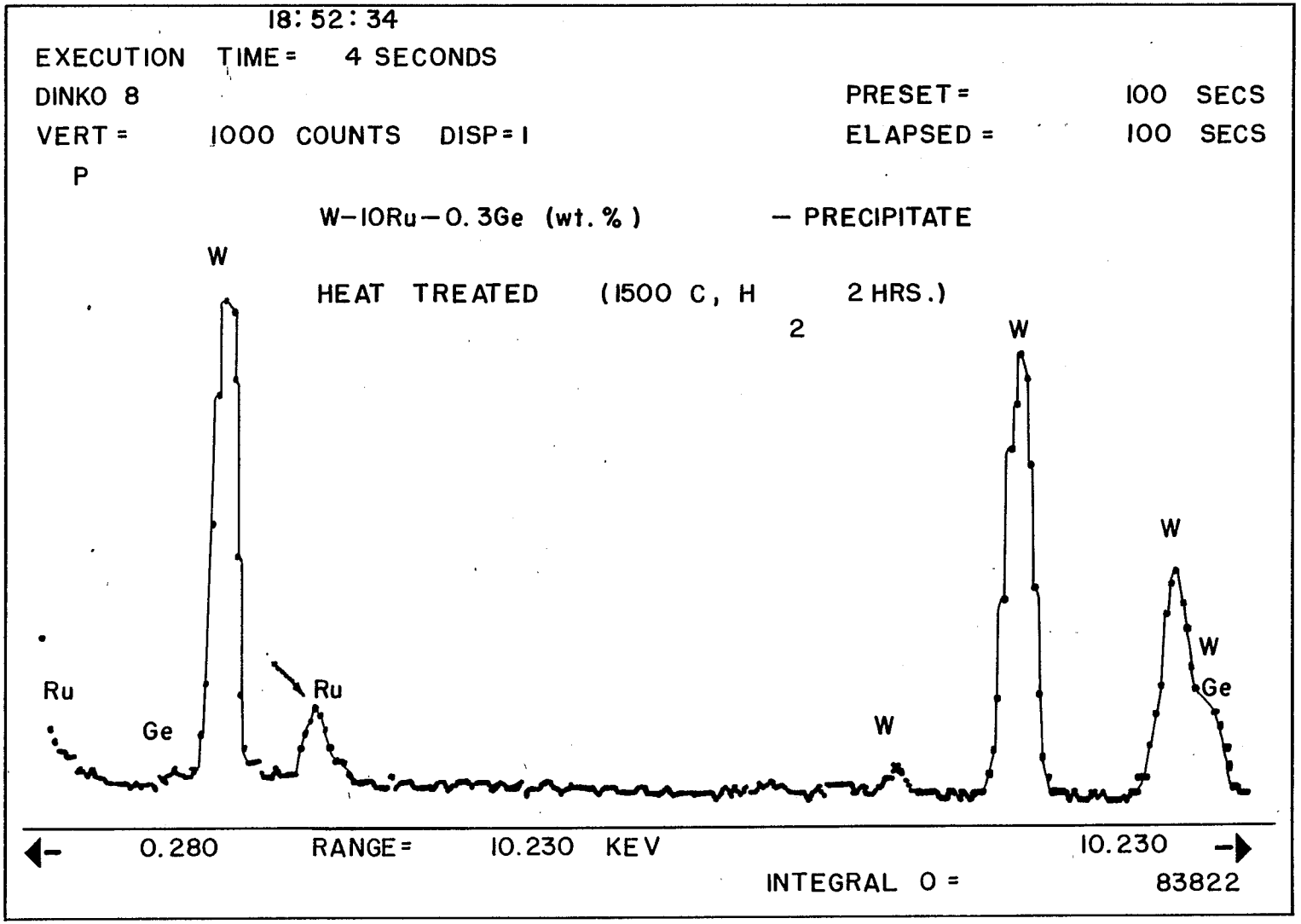

Another ternary system alloy, W-10Ru-0.3Ge, was studied by TEM. The TEM micrographs (FIGS. 11*a* and *b*) indicate that Ru and Ge are dissolved in the matrix in the as-quenched state. However, in the annealed state (1500° C.), a large volume fraction of a second phase is formed in the matrix (FIGS. 12*a* and *b*). The second phase has a partial coherency with the matrix and grows directionally, forming networks as shown in FIGS. 12*a* and *b*. The EDX spectra of the matrix (FIG. 13*a*) and precipitates (FIG. 13*b*) of this alloy show that the precipitates contain more Ru ,than the matrix. From the equilibrium phase diagram of W-Ru, it appears that the second phase is a Ru rich terminal solid solution. The estimated volume fraction of the second phase from the phase diagram is approximately 10%.

Mechanical Properties - Ductility And Hardness

The results of microhardness and ductility measurements on alloys according to the invention are set forth in Tables 1 through 3.

TABLE 1

| Rapidly Solidified Binary W Alloys | | | | |
|---|---|---|---|---|
| | Microhardness | | Thickness Reduction in Bulge Test (%) | |
| Binary System (wt. %) | As-Quenched GPa | Annealed* GPA | As-Quenched | Annealed* |
| W—0.1 B | 5.3 | 4.78 | 1.0 | 0.89 |
| W—0.1C | 5.58 | 4.64 | 0.69 | 0.85 |
| W—0.3Si | 4.94 | 3.87 | 0.78 | 0.75 |
| W—0.4Al | 10.0 | 6.7 | 0.46 | 0.92 |
| W—10V | 4.68 | 4.7 | 0.24 | 0.19 |
| W—10Cr | 7.6 | 6.3 | 1.21 | 0.94 |
| W—10Mn | 5.7 | 3.8 | 1.59 | 0.94 |
| W—10Fe | 6.0 | 8.5 | 0.41 | 0.49 |
| W—10Co | 6.6 | 4.4 | 0.86 | 0.37 |
| W—10Ni | 5.7 | — | 0.71 | 0.42 |
| W—10Cu | 3.1 | 3.0 | 1.45 | 0.53 |
| W—1.0Ge | 4.7 | 6.5 | 0.45 | 0.67 |
| W—10Y | 4.1 | 3.9 | 0.57 | 0.28 |
| W—10Nb | 4.68 | 5.3 | 0.11 | 0.16 |
| W—10Mo | 4.3 | 4.3 | 0.33 | 0.58 |

TABLE 1-continued

| Rapidly Solidified Binary W Alloys | | | | |
|---|---|---|---|---|
| | Microhardness | | Thickness Reduction in Bulge Test (%) | |
| Binary System (wt. %) | As-Quenched GPa | Annealed* GPA | As-Quenched | Annealed* |
| W—10Ru | 9.44 | 6.61 | 0.74 | 1.64 |
| W—10Rh | 10.76 | 4.93 | 1.7 | 0.51 |
| W—10Ta | 5.16 | 5.22 | 0.34 | 0.51 |
| W—10Re | 4.4 | 4.1 | 1.23 | 1.1 |
| W—10Os | 9.07 | 10.24 | 0.85 | 0.40 |
| W—10Ir | 10.1 | 8.81 | 1.11 | 0.50 |
| Pure W | 4.2 | 4.3 | 0.47 | 0.54 |
| W—1La | 4.5 | 4.2 | 0.21 | 0.21 |
| W—1Lu | 4.63 | 4.55 | 0.62 | 0.58 |
| W—1Th | 4.4 | 4.13 | 0.9 | 0.62 |
| W—0.2B | 6.28 | 5.39 | 0.63 | 0.58 |
| W—0.2C | 6.02 | 5.0 | 0.64 | 0.81 |
| W—0.5Si | 5.64 | 4.69 | 0.75 | 1.48 |
| W—5Mn | 4.4 | 3.5 | 0.32 | 0.51 |
| W—10Mn | 5.7 | 3.5 | 1.59 | 0.31 |
| W—15Mn | 4.9 | 3.5 | 0.52 | 0.23 |
| W—20Mn | 5.0 | 3.1 | 0.25 | 0.06 |

*Annealing at 1500° C., 3 h in hydrogen atmosphere.

TABLE 2

| Rapidly Solidified Ternary W Alloys | | | | |
|---|---|---|---|---|
| | Microhardness | | Thickness Reduction in Bulge Test(%) | |
| Ternary W Alloy (wt. %) | As-Quenched GPa | Annealed GPa | As-Quenched | Annealed |
| W—10V—0.3Si | 8.4 | 7.7 | 0.61 | 0.64 |
| N—10Cr—0.3Si | 6.2 | 5.0 | 0.52 | 0.83 |
| W—10Nb—0.3Si | 6.1 | — | 0.66 | 0.62 |
| W—10Mo—0.3Si | 4.6 | 5.2 | 0.40 | 0.67 |
| W—10Re—0.3Si | 5.17 | 5.24 | 0.67 | 1.29 |
| W—4Ru—0.5Si | 6.43 | 4.79 | 0.39 | 0.79 |
| W—10Ru—0.3Ge | 8.2 | 6.0 | 2.98 | 1.47 |
| W—10Rh—0.3Ge | 10.6 | 4.4 | 0.81 | 0.26 |
| W—10Re—0.3Ge | 3.7 | 3.9 | 1.18 | 1.23 |
| W—10Os—0.3Ge | 6.6 | 7.4 | 1.11 | 1.20 |
| W—10Ir—0.3Ge | 10.0 | 7.7 | 1.16 | 0.75 |
| W—10Ru—0.3Y | 9.9 | 6.4 | 2.17 | 0.51 |
| W—10Re—0.3Y | 4.0 | 4.4 | 1.06 | 1.43 |
| W—10Os—0.3Y | 7.8 | 8.0 | 2.73 | 1.16 |
| W—10Ir—0.3Y | 11.2 | 7.4 | 1.50 | 0.92 |
| W—10Re—1La | 4.1 | 4.1 | 0.45 | 0.48 |
| W—10V—1Lu | 5.1 | 6.4 | 0.45 | 0.09 |
| W—10Nb—1Lu | 5.0 | 4.9 | 0.27 | 0.33 |
| W—10Re—1Lu | 4.8 | 4.0 | 0.52 | 0.65 |
| W—10V—1Th | 5.1 | 5.0 | 0.9 | 0.19 |
| W—10Nb—1Th | 4.8 | 4.9 | 0.55 | 0.14 |
| W—10Re—1Th | 4.2 | 4.5 | 0.61 | 0.82 |

TABLE 3

| Rapidly Solidified W Alloys Containing Si | | | | |
|---|---|---|---|---|
| | Hardness, GPa | | Cold Rolling | |
| Alloy* | As-Quenched | Annealed | % Deduction at Failure | Strain Rate |
| Pure W 99.9% | 4.4 | 4.1 | 1.2 | 0.05 |
| W—0.15Si | 4.7 | 4.3 | 1.6 | 0.05 |
| W—0.3Si | 4.9 | 4.4 | 1.8 | 0.05 |
| W—0.5Si | 5.5 | 4.7 | 2.2 | 0.05 |
| W—1.0Si | — | — | 3.5 | 0.05 |
| W—10Re | 4.2 | 4.1 | 2.4 | 0.05 |
| W—10Re—0.15Si | 4.3 | 4.8 | 2.1 | 0.05 |
| W—10Re—0.3Si | 4.7 | 5.2 | 1.8 | 0.05 |
| W—10Re—0.5Si | 5.0 | 5.3 | 1.2 | 0.05 |
| W—10Re—1.0Si | 6.2 | 6.2 | — | — |

*The alloys were cast into buttons in an arc melting furnace and homogenized at 1500° C. for 1 hour under hydrogen atmosphere.

Table 1 sets forth microhardness and ductility measurements of binary tungsten alloys as compared to pure tungsten. The alloys were processed by sintering and rapid quenching with the exception of the W-Ge and W-Al alloys which were processed by mechanical alloying followed by sintering and rapid quenching.

The group IIIA (B,Al) and IVA (C, Si Ge) elements as additive elements have a minor affect on alloy hardness, with the exception of aluminum, but have a major affect on alloy ductility. For example, alloys containing group IIIA and IVA elements and exhibiting enhanced ductility are W-0.2B, W-0.5Si and W-0.4Al.

The precise reason for such a ductilizing affect is not known. However, it is interesting to note that the as-quenched alloys do not show any ductility enhancement as compared to pure tungsten whereas the same alloy after being vacuum annealed indicates a significant enhancement in ductility as compared to pure tungsten. For example, the as-quenched W-0.5Si has a ductility value of 0.75 which increases to 1.48 upon annealing. Similarly, the ductility value of the as-quenched W-0.4Al alloy increases from 0.44 to 0.92 upon annealing. In particular, the manifestation of such an effect is found in the W-Si system. Overall, a large ductility difference between the as-quenched state and the annealed state is noted in the binary system.

Ternary tungsten alloys were also tested as to microhardness and ductility. The results are tabulated in Table 2. Overall, the microhardness and ductility in rapidly solidified ternary tungsten alloys are the result of a combined affect by both the alloying element and the additive element. Although it is difficult to separate the affect of the alloying element from that of the additive element, a clear trend by either alloying element or additive element can be identified from Table 2.

First, the majority of the ternary alloys shows higher hardness in the as-quenched state as compared to the annealed state. This effect may be explained from the fact that in the as-quenched alloys, the amount of alloying element or additive element is within the extended solubility limit so that the alloys enjoy full solid solution strengthening which provides harder alloys. By contrast, microstructural coarsening in the annealed alloys results in the reduction of strength.

Second, marked ductility improvement from that of pure tungsten is achieved in alloys containing silicon, germanium and yttrium, in contrast to the ductility decrease in alloys containing rare earth and actinide elements such as lanthanum.

Among carbon, boron, silicon, aluminum, and germanium, silicon shows the greatest improvement in room temperature ductility of tungsten alloys. Table 3 shows percentage of maximum cold rolled reduction before failure for tungsten alloys with silicon. The 0.5 weight percent silicon has an equivalent affect on ductility as that of 10 weight percent rhenium in binary tungsten alloys. However, in the ternary system W-Re-Si, the increase in silicon content with constant rhenium shows a maximum ductility at 0.5 weight percent silicon.

Figure 14:
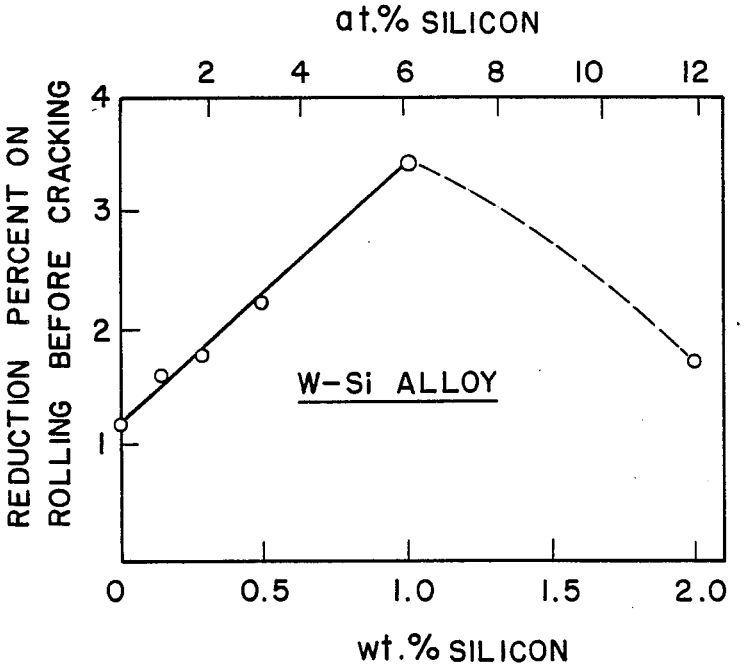
FIG. 14 is a plot of rolling deformation (%) with a strain rate of 0.05/sec. v. Si concentration in W.

The ductility increase in tungsten alloys by a small amount of silicon, as shown in FIG. 14, is an unusual phenomenon. There are a number of possible explanations for such ductility enhancement.

The grain boundary may be strengthened by silicon addition. Silicon increases plastic deformatiom by preventing intergranular failure which is dominant in tungsten alloys. However, it is not possible to explain the concommitant increase in grain boundary cohesion from a semi-theoretical point of view according to which the sublimination energy $H_{sub}$ of the segregating solute should be larger than that of the solvent in order to enhance grain boundary cohesion (20). On the contrary, $H_{sub}$ of Si is lower than that of W. Alternatively, silicon may lower the ductile-brittle transition temperature of tungsten by either forming a solid solution with tungsten or by removing oxygen from the matrix. However, other deoxidants such as rare earth elements and actinide elements do not show such a distinct effect on ductility. Therefore, it is not likely that the ductility improvement in tungsten-silicon alloys is merely a result of a "scavenger" effect by silicon.

Another possible explanation of such ductility enhancement may lie in the grain size effect since the grain size of tungsten-silicon alloys is 1–2 μm vs. 50–100 μm for pure tungsten alloys. During solidification of tungsten-silicon alloys, the silicon atoms may act as nucleation centers, thereby increasing nucleation frequency. However, the similar grain size in rapidly solidified tungsten-nickel alloys does not enhance ductility.

In accordance with the invention, rapidly solidified binary and ternary tungsten alloys show significant hardness increase at room temperature accompanied by refined microstructures. Tables 1–3 show that an optimum amount of silicon, boron, germanium or aluminum when added to tungsten significantly enhances both ductility and strength.

REFERENCES

1. *Rapid Solidification Processing,* Vol. I, II, R. Mehrabian, B. H. Kear, M. Cohen, editors, Claitor's Publishing Division (Baton Rouge, LA 1977, 1980); ibid, vol. III, R. Mehrabian, editor (1983).
2. *Proc. Rapidly Quenched Metals,* Vol. II, N. J. Grant and B. C. Giesson, editors, MIT Press (1976); ibid, vol, III, B. Cantor, editor (Brighton, England, 1978); ibid, vol. IV, T. Masumoto and K. Suzuki, editors (Sendai, Japan 1982).
3. H. Jones, *Aluminum,* 54, 275 (1978).
4. J. R. Pickens, J. Mat. Sci., 16, 1437 (1981).
5. S. H. Whang, *J. Metals,* 36, 34 (1984).
6. C. S. Chi and S. H. Whang, *Proc. Mater Res. Soc. Sym.* (Boston Nov. 1983) (in press);
7. S. M. L. Sastry et al., *J. Metals,* 35, 21 (1983).
8. R. W. Armstrong et al., *Refractory Metals and Alloys,* 17, 159, Interscience (New York 1963).
9. B. A. Wilcox, *Refractory Metals and Alloys,* J. Macklin et al., editors, 1–39 (New York 1968).
10. S. H. Whang and B. C. Gressin, *Proc. Third Conf. Rapid Solidification Processing,* R. Mehrabian, editor, NBS, 439–442 (MD 1983).
11. S. H. Whang, *J. Mat. Sci.,* 21(7), 2224–2238 (1986).
12. Metals Handbook, 7, 293–493 (1984).
13. U.S. Pat. No. 4,221,257 to Narashimhan.
14. U.S. Pat. No. 4,212,343 to Narashimhan.
15. J. Hubert et al., "Manufacture of Metallic Wires and Ribbons by the Melt Spin and Melt Drag Processes", Z. Metallk., 64, 835 (1973).
16. Metals Handbook, 7, 65–70 and 722–727 (1984).
17. P. Pietrokowsky, "Novel Mechanical Device for Producing Rapidly Cooled Metals and Alloys of Uniform Thickness," *Rev. Sci. Instrum.,* 34, 445–446 (1963).
18. R. W. Cahn, "Novel Splat Quenching Techniques and Methods for Assessing Their Performance", *Mater. Sci. Eng.,* 23, 83–86 (1976).
19. M. Ohring and A. Haldipur, "A Versatile Arc Melting Apparatus for Quenching Molten Metals and Ceramics", *Rev. Sci. Instrum.,* 42, 530–531 (1971).
20. M. P. Seah, *Acta Metall.,* 28, 955 (1980).

I claim:

1. A tungsten-rich alloy comprising a rapidly solidified, single phase, fine grain mixture of formula $$W_{100-P}M_XRE_YME_Z$$

wherein:

W is tungsten;

M is one or more elements selected from the group consisting of transition elements;

RE is an element selected from the group consisting of rare earth and actinide elements;

Me is silicon, boron, germanium or aluminum;

X is 0 to 25 weight percent;

Y is 0 to 2 weight percent;

Z is 0.1 to 3 weight percent; and

P equals X+Y+Z where P≦26 weight percent; said alloy having improved ductility and hardness.

2. An alloy as claimed in claim 1 wherein M is rhenium or ruthenium, ME is silicon and Y is 0.

3. An alloy as claimed in claim 1 wherein ME is silicon and X and Y are 0.

4. An alloy as claimed in claim 2 which is W-10Re-0.3Si.

5. An alloy as claimed in claim 3 which is W-0.5Si.

6. A tungsten-rich alloy of formula $$W_{100-P}ME_Z$$

wherein:

W is tungsten;

ME is germanium;

Z is 0.1 to 3 weight percent; and

P≦26 weight percent.

7. An alloy as claimed in claim 6 which is W-1.0Ge.

8. A tungsten-rich alloy comprising a rapidly solidified, single phase, fine grain mixture of formula $$W_{100-P}M_XRE_YME_Z$$

wherein:

W is tungsten;

M is one or more elements selected from the group consisting of transition elements;

RE is an element selected from the group consisting of rare earth and actinide elements;

ME is silicon, boron, germanium or aluminum;

X is 0 to 25 weight percent;

Y is 0 to 2 weight percent;

Z is 0.1 to 3 weight percent; and

P equals X+Y+Z where P≦26 weight percent; said alloy having ductility and hardness and having been prepared by a process comprising the steps of:

(a) blending a mixture of the powdered, elemental components of the alloy;

(b) compacting said blended mixture into a solid mass;

(c) hot-consolidating said compacted solid mass;

(d) melting said hot-consolidated mass; and (e) rapidly solidifying said molten mass at a cooling rate of at least 1,000° C./sec.

* * * * *